US009004651B2

(12) United States Patent
Nystrom et al.

(10) Patent No.: US 9,004,651 B2
(45) Date of Patent: Apr. 14, 2015

(54) THERMO-PNEUMATIC ACTUATOR WORKING FLUID LAYER

(71) Applicant: Xerox Corporation, Norwalk, CT (US)

(72) Inventors: Peter J. Nystrom, Webster, NY (US); Andrew W. Hays, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/020,198

(22) Filed: Sep. 6, 2013

(65) Prior Publication Data

US 2015/0070441 A1 Mar. 12, 2015

(51) Int. Cl.

| | |
|---|---|
| ***B41J 2/05*** | (2006.01) |
| ***B41J 2/14*** | (2006.01) |
| ***B41J 2/16*** | (2006.01) |

(52) U.S. Cl.

CPC ..... *B41J 2/14427* (2013.01); *B41J 2/1607* (2013.01)

(58) Field of Classification Search

CPC ..... B41J 2/14064
USPC ..... 347/20, 44, 47, 61–65, 67, 84–87, 54, 347/56

See application file for complete search history.

(56) References Cited

U.S. PATENT DOCUMENTS

| | | | |
|---|---|---|---|
| 5,467,112 | A | 11/1995 | Mitani |
| 5,539,437 | A | 7/1996 | Penwell |
| 5,943,074 | A | 8/1999 | Kashino et al. |
| 6,074,043 | A | 6/2000 | Ahn |
| 6,130,690 | A | 10/2000 | Ahn |
| 6,199,600 | B1 | 3/2001 | Ahn et al. |
| 6,206,505 | B1 | 3/2001 | Yoshihira et al. |
| 6,270,197 | B1 | 8/2001 | Ahn et al. |
| 6,270,198 | B1 | 8/2001 | Ahn et al. |
| 6,276,783 | B1 | 8/2001 | Ishinaga et al. |
| 6,284,436 | B1 | 9/2001 | Ahn et al. |
| 6,286,940 | B1 | 9/2001 | Sugiyama et al. |
| 6,312,109 | B1 | 11/2001 | Chen |
| 6,315,398 | B1 | 11/2001 | Burke et al. |
| 6,328,430 | B1 * | 12/2001 | Ahn et al. ..... 347/65 |
| 6,334,670 | B1 | 1/2002 | Yoshihira et al. |
| 6,367,705 | B1 | 4/2002 | Lee et al. |
| 6,378,991 | B1 | 4/2002 | Lim et al. |
| 6,386,686 | B1 | 5/2002 | Kubota et al. |
| 6,390,604 | B2 | 5/2002 | Kashino et al. |
| 6,431,688 | B1 | 8/2002 | Shin et al. |
| 6,436,301 | B1 | 8/2002 | Hiroki et al. |
| 6,443,562 | B1 | 9/2002 | Yoon |
| 6,540,336 | B2 | 4/2003 | Kubota et al. |
| 6,705,716 | B2 | 3/2004 | Mott |
| 2001/0003460 | A1 | 6/2001 | Yoshihira et al. |
| 2003/0063162 | A1 | 4/2003 | Yoshihira et al. |

FOREIGN PATENT DOCUMENTS

| | | | |
|---|---|---|---|
| CA | 2290916 | A1 | 6/2000 |
| EP | 6651066 | A2 | 8/1995 |
| EP | 816083 | A2 | 1/1998 |

(Continued)

*Primary Examiner* — Juanita D Jackson
(74) *Attorney, Agent, or Firm* — MH2 Technology Law Group LLP

(57) ABSTRACT

An ink jet printhead including a thermo-pneumatic actuator array for ejecting ink from an array of nozzles. The actuator array may include a plurality of channels in fluid communication with a plurality of working fluid chambers. After completing formation of the actuator array, working fluid may be injected into a working fluid inlet on an exterior of the actuator array and into the plurality of working fluid chambers through the plurality of channels.

11 Claims, 7 Drawing Sheets

(56) References Cited

FOREIGN PATENT DOCUMENTS

| | | | |
|---|---|---|---|
| EP | 1122069 | A1 | 8/2001 |
| EP | 1136271 | A1 | 9/2001 |
| EP | 1302321 | A2 | 4/2003 |
| GB | 2286157 | A | 8/1995 |

* cited by examiner

THERMO-PNEUMATIC ACTUATOR WORKING FLUID LAYER

TECHNICAL FIELD

The present teachings relate to the field of ink jet printing devices and, more particularly, to methods and structures for an array of ink jet printhead actuators.

BACKGROUND

Drop on demand ink jet technology is widely used in the printing industry. Printers using drop on demand ink jet technology can use either thermal ink jet (TIJ) technology or piezoelectric technology. In contrast to thermal ink jet printheads, printheads using piezoelectric technology are more expensive to manufacture but may use a wider variety of inks. Piezoelectric printheads are also relatively larger than thermal printheads for the same nozzle count, which may require a wider spacing of nozzles from which ink is ejected during printing and result in a lower ink drop density and velocity. Low drop velocity decreases the tolerance for drop velocity variation and directionality which, in turn, may decrease image quality and printing speed.

Piezoelectric ink jet printheads may include an array of piezoelectric elements (i.e., transducers or PZTs). One process to form the array may include detachably bonding a blanket piezoelectric layer to a transfer carrier with an adhesive, and dicing the blanket piezoelectric layer to form a plurality of individual piezoelectric elements. A plurality of dicing saw passes can be used to remove all the piezoelectric material between adjacent piezoelectric elements to provide the correct spacing between each piezoelectric element.

Piezoelectric ink jet printheads can typically further include a flexible diaphragm to which the array of piezoelectric elements is attached. When a voltage is applied to a piezoelectric element, typically through electrical connection with an electrode electrically coupled to a power source, the piezoelectric element bends or deflects, causing the diaphragm to flex which expels a quantity of ink from a chamber through a nozzle. The flexing further draws ink into the chamber from a main ink reservoir through an opening to replace the expelled ink.

Thermal ink jet printheads include a thermal energy generator or heater element, usually a resistor, separated from a nozzle within a nozzle plate by an ink channel. Each heater element may be individually addressed so that an activation of an electrical pulse heats the resistor. The heat is transferred from the heater to the ink, which causes a bubble to form within the ink. For example, a water-based ink reaches a critical temperature of 280° C. for bubble nucleation. The nucleated bubble or water vapor thermally isolates the ink from the heater element to prevent further transfer of heat from the resistor to the ink, and the electrical pulse is deactivated. The nucleating bubble expands until excess heat diffuses away from the ink. During the expansion of the vapor bubble, the ink is forced toward the nozzle and begins to bulge at the exterior of the nozzle plate, but is contained by surface tension of the ink as a meniscus.

When the electrical pulse is deactivated, excess heat is diffuses away from the ink and the bubble begins to contract and collapse. The ink within the channel between the bubble and the nozzle begins to move toward the contracting bubble, causing a separation of the ink bulging from the nozzle plate and forms an ink droplet. Acceleration of ink out of the nozzle during the expansion of the bubble provides the momentum and velocity to expel the ink droplet from the nozzle toward a recording medium such as paper in a substantially straight line direction. Once the ink is ejected from the nozzle, the channel may be re-fired after a delay that is sufficient to enable refilling of ink within the channel. A thermal printhead design is discussed in U.S. Pat. No. 6,315,398, incorporated herein by reference in its entirety.

Another type of printhead includes the use of thermo-pneumatic actuators (TPA's). TPA's are similar to thermo-pneumatic (TP) micro-pumps, but do not include inlet and outlet valves. Most printheads rely on surface tension, meniscus pressures, and ink flow impedance to manage fluid flow. In contrast, printheads employing the use of TPA's use a membrane to separate a pumped fluid (e.g., ink) from a working or trapped fluid that is sealed within each actuator. Because the ink itself may have less than optimal thermal characteristics, the working fluid is selected for its improved thermal performance during operation of the device. The membrane isolates the working fluid and prevents it from mixing with the pumped fluid. A lower half of the TPA (the portion beneath the membrane) includes a resistive heater and the working fluid, while the upper half of the TPA (the portion between the membrane and the nozzle plate) includes the pumped fluid.

A printhead device design and manufacturing process that allow for dispensing of the working fluid into the actuators prior to use and replacement of working fluid as a maintenance process would be desirable.

SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

In an embodiment, a printhead may include a plurality of thermo-pneumatic (TP) actuators as part of a TP actuator array, wherein the TP actuator array includes a substrate, a plurality of resistors, wherein each resistor of the plurality of resistors is individually addressable, a standoff layer formed over the substrate, wherein the standoff layer comprises a plurality of channels therethrough that extend between adjacent TP actuators of the TP actuator array, a TP actuatable membrane between a working fluid chamber and an ink chamber for each of the plurality of TP actuators, wherein the TP actuatable membrane is attached to the standoff layer, a support layer attached to the TP actuatable membrane, wherein the TP actuatable membrane is interposed between the support layer and the standoff layer, and a nozzle plate attached to the support layer.

In another embodiment, a printer may include a printhead including a plurality of thermo-pneumatic (TP) actuators as part of a TP actuator array, wherein the TP actuator array includes a substrate, a plurality of resistors, wherein each resistor of the plurality of resistors is individually addressable, a standoff layer formed over the substrate, wherein the standoff layer comprises a plurality of channels therethrough that extend between adjacent TP actuators of the TP actuator array, a TP actuatable membrane between a working fluid chamber and an ink chamber for each of the plurality of TP actuators, wherein the TP actuatable membrane is attached to the standoff layer, a support layer attached to the TP actuatable membrane, wherein the TP actuatable membrane is interposed between the support layer and the standoff layer, and a nozzle plate attached to the support layer, and a printer housing that encases the printhead.

In another embodiment, a method for forming a printhead having a plurality of thermo-pneumatic (TP) actuators as part of a TP actuator array, wherein the method includes providing a substrate and a plurality of individually addressable resistors, forming a standoff layer over the substrate, etching the standoff layer to form a plurality of channels through the standoff layer, attaching a TP actuatable membrane to the standoff layer to form a plurality of working fluid chambers over the plurality of resistors such that the plurality of channels through the standoff layer open into the plurality of working fluid chambers, and attaching a support layer to the actuatable membrane, wherein the TP actuatable membrane is interposed between the support layer and the standoff layer.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

It should be noted that some details of the FIGS. have been simplified and are drawn to facilitate understanding of the present teachings rather than to maintain strict structural accuracy, detail, and scale.

DETAILED DESCRIPTION

Reference will now be made in detail to exemplary embodiments of the present teachings, examples of which are illustrated in the accompanying drawings. Wherever possible, the same reference numbers will be used throughout the drawings to refer to the same or like parts.

As used herein, unless otherwise specified, the word "printer" encompasses any apparatus that performs a print outputting function for any purpose, such as a digital copier, bookmaking machine, facsimile machine, a multi-function machine, electrostatographic device, etc.

An embodiment of the present teachings may include a printhead including the use of a thermo-pneumatic actuator (TPA) array including a plurality of TPA's to eject ink through a plurality of ejection nozzles onto a recording medium such as paper. A working fluid of each TPA may be separated from a pumped fluid (e.g., ink) by an actuatable membrane. In an embodiment, a plurality of working fluid channels interconnect with a plurality of working fluid chambers that form part of the TPA array. Working fluid may be introduced into the working fluid chamber of each TPA after structural formation of the TPA has been completed, and replacement of the working fluid may be performed after initial printhead use, for example as a maintenance process.

Figure 1:
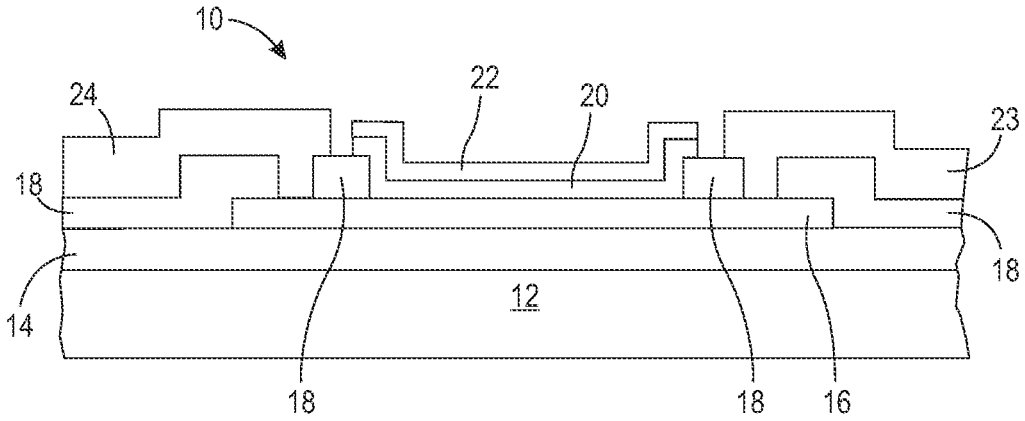
FIGS. 1, 2A, 2B, and 3-7 are cross sections.

U.S. Pat. No. 6,315,398, incorporated by reference above, discloses a thermal printing device. In-process structures which can be formed during an embodiment of the present teachings are depicted in FIGS. 1-6. FIG. 1 depicts an exemplary heater wafer 10 that may be formed by one of ordinary skill in the art and used in an embodiment of the present teachings, although other heater designs are contemplated. It will be understood that the embodiments depicted in each of the FIGS. are generalized schematic illustrations and that other components may added or existing components may be removed or modified.

The heater wafer of FIG. 1 includes a substrate 12 such as a semiconductor (silicon, gallium arsenide, etc.) substrate, which may include various other structures such as ion-doped regions, dielectric layers, and conductive layers formed thereon and/or therein (not individually depicted for simplicity). Further, an underglaze layer 14, for example a dielectric layer such as silicon dioxide ($SiO_2$), may be formed as an isolation region. A patterned resistor 16 (i.e., a resistive heating element) may then be formed on the underglaze layer 14 using, for example, a chemical vapor deposition (CVD) of polysilicon, a metal, or a metal alloy.

Figure 4:
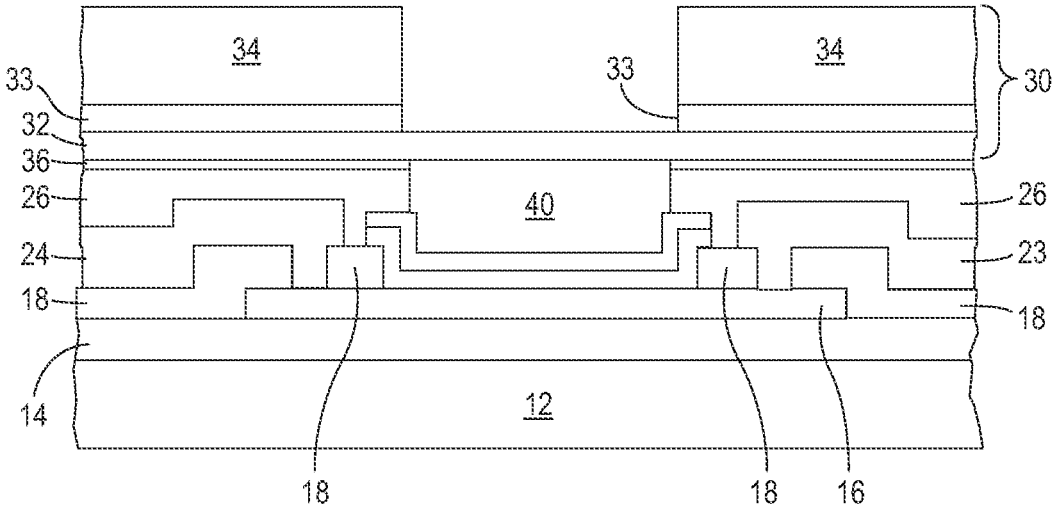
Figure 5:
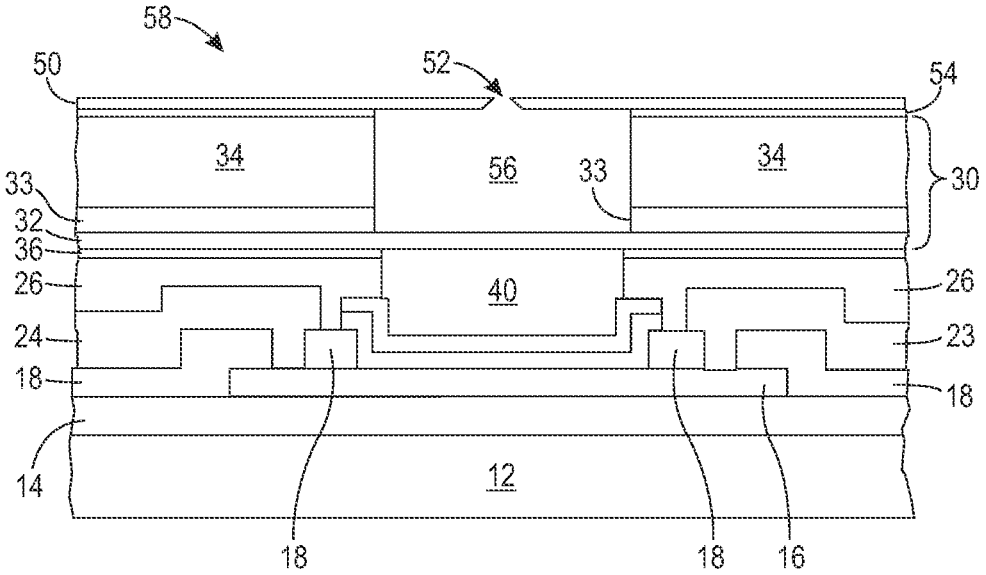

It will be appreciated that, while only one resistor 16 is depicted in FIG. 1, a plurality of resistors 16, as well as the other structures of FIGS. 1-6, may be repeated across the substrate 12 and simultaneously formed as a resistor array, with one resistor 16 associated with each nozzle 52 (FIG. 5, discussed below). Further, in another embodiment, each resistor 16 of the heater wafer 10 may be provided by one or more implanted region within the substrate 12 (not individually depicted for simplicity) rather than being a separate individual layer overlying the substrate 12 as depicted in FIG. 1. It will thus be appreciated that the FIGS. are schematic depictions and that structural components may be added or existing structural components and/or processing stages may be removed or modified. Each resistor 16 of the resistor array will thus be formed as part of an actuator for ejecting ink from a nozzle. The resistor array is thus part of an actuator array configured to eject ink from an array of nozzles.

Subsequently, a dielectric layer 18, for example phosphosilicate glass (PSG), is formed, planarized, and patterned to leave contact openings to the resistor 16. Next, a dielectric passivation layer 20 and a protective layer 22 of a material such as tantalum are formed and patterned as depicted. The dielectric passivation layer 20 prevents physical contact between the resistor 16 and the possibly corrosive working fluid during use of the device, while the protective layer 22 protects the passivation layer 20 from similar ink contact.

To complete the FIG. 1 heater wafer 10, an electrode layer, for example a layer of aluminum or other conductor, is deposited using, for example, sputtering or CVD, then etched to form a first electrode 23 and a second electrode 24 such that each resistor 16 in the resistor array is individually addressable.

Figure 2A:
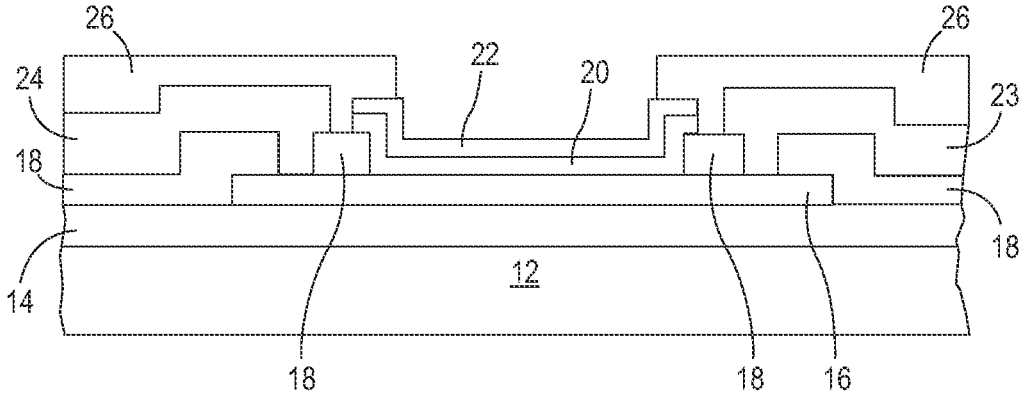
Figure 2B:
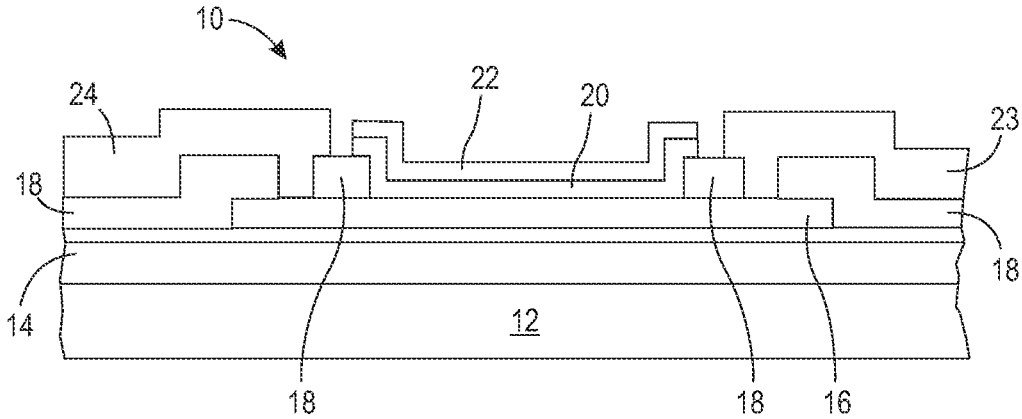
Figure 2C:
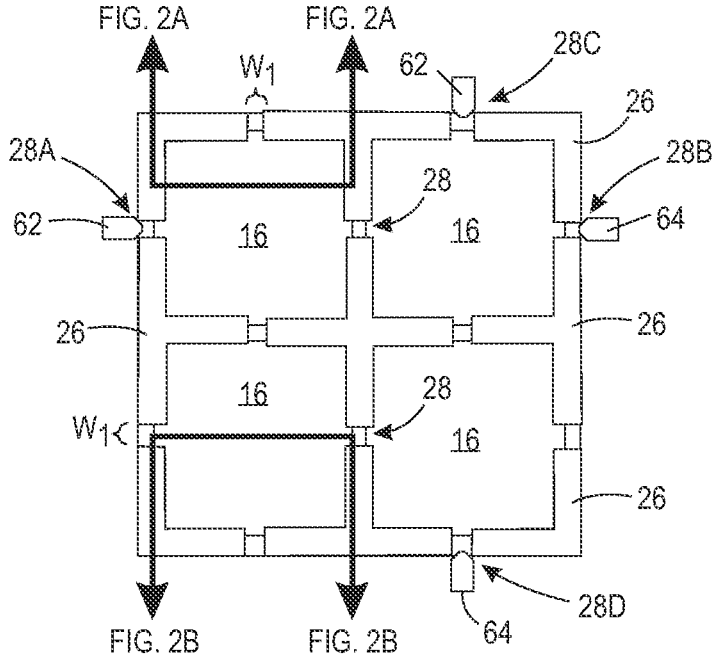
FIGS. 2C and 2D are plan views, depicting in-process structures in accordance with an embodiment of the present teachings.
Figure 2D:
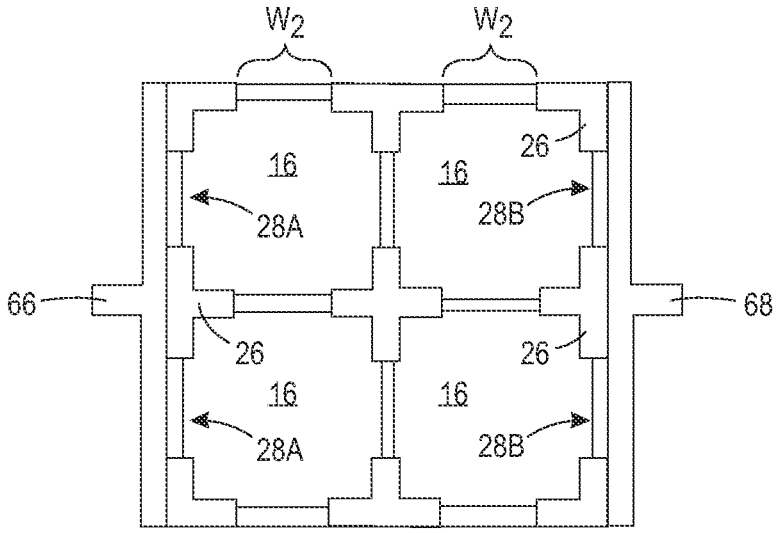

Next, as depicted in the cross sections of FIGS. 2A and 2B and the plan views of FIGS. 2C and 2D, a standoff layer 26, for example PSG, $SiO_2$, SU-8 photoresist, metal, etc., is formed, planarized, and patterned as depicted. The standoff layer 26 may function as an overglaze passivation layer which provides a stable, planar base for subsequent processing as well as a containment structure for the working fluid as described below. The standoff layer 26 may also be used to define a height of a working fluid chamber 40 (FIG. 4). In an embodiment, standoff layer 26 may have a thickness of between about 0.025 μm and about 2.5 μm, or between about 0.1 μm and about 0.2 μm thick, although other thicknesses are contemplated depending on the device design. As depicted, the standoff layer 26 may include a plurality of channels or openings 28 that allow the working fluid to be dispensed within the printhead subsequent to completion of the actuator array. In this embodiment, each completed actuator may include four channels 28 in fluid communication with a working fluid chamber 40 (FIG. 4) that allow working fluid to flow into and out of the working fluid chamber as described below, although other embodiments are contemplated. The channels 28 may be arranged in a plurality of rows and columns to provide access to each actuator in the actuator array. The channels 28 may include a row working fluid inlet 28*a*, a row working fluid outlet 28*b*, a column working fluid inlet 28*c*, and a column working fluid outlet 28*d*, formed from the channels 28 at an exterior surface of the actuator array. The channels 28 may be designed to have a relatively narrower width $W_1$ as depicted in FIG. 2C or as a relatively wider width $W_2$ as depicted in FIG. 2D, depending on various factors as described below. While FIGS. 2C and 2D depict a 2×2 actuator array, it will be understood that an actuator array may have hundreds or thousands of actuators.

Figure 3:
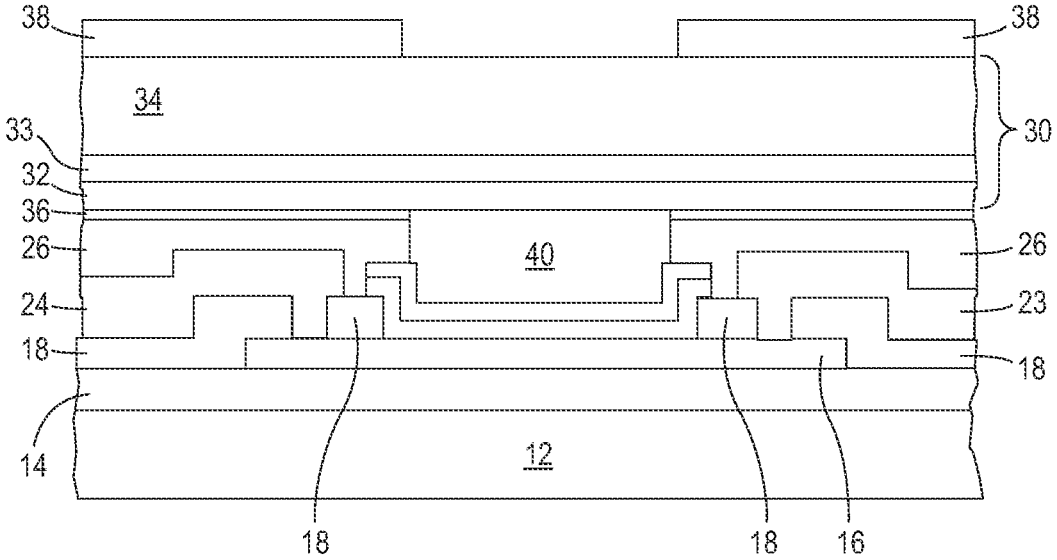

Subsequently, a membrane layer 32 and a support layer 34 are attached to the FIG. 2 structure as depicted in FIG. 3. In an embodiment, the membrane layer 32 and the support layer 34 may be part of a silicon-on-insulator (SOI) wafer 30 that includes other layers such as a buried layer 33, for example a buried oxide layer. Thus, in an embodiment, the SOI wafer 30 may include a device layer 32, for example a monocrystalline first silicon layer having a thickness of between about 1.0 μm and about 20 μm, or between about 10 μm and about 12 μm. The SOI wafer may further include a dielectric layer 33, such as an oxide layer, for example a buried oxide layer, having a thickness of between about 0.01 μm and about 5.0 μm thick. The SOI wafer may further include a second silicon layer 34, for example a silicon handle layer (i.e., silicon handle wafer), having a thickness of between about 500 μm and about 800 μm. The buried oxide layer 33 is interposed between, and physically separates, the device layer 32 from the handle layer 34. The silicon layer 32 may be attached to the standoff layer 26 using an adhesive 36 such as an epoxy, such as a spin-coated, evaporated, vapor deposited, sprayed, etc. epoxy, a resin adhesive, or other materials that are suitably compatible with working fluid and meets processing conditions. Further, the adhesive 36 may be applied to the silicon layer 32 and/or the standoff layer 26 using, for example, screen printing, contact printing, etc. In another embodiment, the silicon layer 32 may be attached to the standoff layer 26 using an anodic or fusion bonding or metal diffusion with silver, gold, etc.

In another embodiment, the membrane layer 32 and the support layer 34 may be separately attached. For example, the membrane 32 may be a polymer layer, a metal layer, a silicon layer, or another layer that is sufficiently thin and flexible to deflect under pressure as described below attached to the standoff layer 26 using adhesive 36. After attaching the membrane 32, a support layer 34, for example an oxide or a nitride, may be deposited on the membrane 32 using a suitable deposition technique. Further, the support layer 34 may be optionally removed or planarized to thin the support layer 34 wafer, for example decrease an etch time of a subsequent etch of the support layer 34. Removal of a portion of the support layer 34 may also be used to define a height of an ink chamber 56 (FIG. 5). Thinning may be performed using a chemical wet or dry etch, a mechanical dry etch, a chemical mechanical planarization (CMP), or an abrasion process.

Subsequently, a patterned photoresist layer 38 may be formed over the support layer 34, such that the patterned photoresist layer 38 exposes the support layer 34 at a location which overlies a working fluid chamber 40 as depicted. Each working fluid chamber 40 within the array of resistors 16 will be similarly exposed by the patterned photoresist layer 38.

Next, an anisotropic etch of the support layer 34 and, optionally, the buried layer 33 is performed to form a plurality of recesses within the support layer 34 and, optionally, the buried layer 33, wherein one recess is formed over each resistor 16 as depicted in FIG. 4. In an embodiment, the silicon layer 32 may be used as an etch stop during the etch of the support layer 34. In another embodiment, the buried layer 33 is used as an etch stop during the etch of the support layer 34, and the membrane 32 is used as an etch stop during the etch of the buried layer 33. After completion of the etch, the patterned photoresist layer 38 is removed to result in a structure similar to that depicted in FIG. 4. It will be appreciated that a device formed in accordance with an embodiment of the present teachings may include various other structures known in the art that are not depicted for simplicity, such as structures that allow an ink feed manifold to be distributed across the printhead.

After forming a structure similar to that depicted in FIG. 4, a suitable nozzle plate 50 having a plurality of ejection nozzles 52 is formed and bonded to the top of the support layer 34 using, for example, an adhesive 54 as depicted in FIG. 5. The nozzle plate 50 may be silicon, glass, one or more of various metals such as stainless steel, a polymer, or combinations thereof. In another embodiment, the nozzle plate 50 is attached to the support layer 34 using fusion or another method. Attaching the nozzle plate 50 forms an ink chamber 56 defined by the membrane 32, the support layer 34, and the nozzle plate 50, and completes the array of actuators 58. In a printhead having intervening features such as a manifold, ink routing layers, and/or other layers interposed between the nozzle plate 50 and the support layer 34, the nozzle plate 50 may be indirectly attached to the support layer 34 through contact with, and direct attachment to, the intervening feature rather than being directly attached to the support layer 34.

Figure 6:
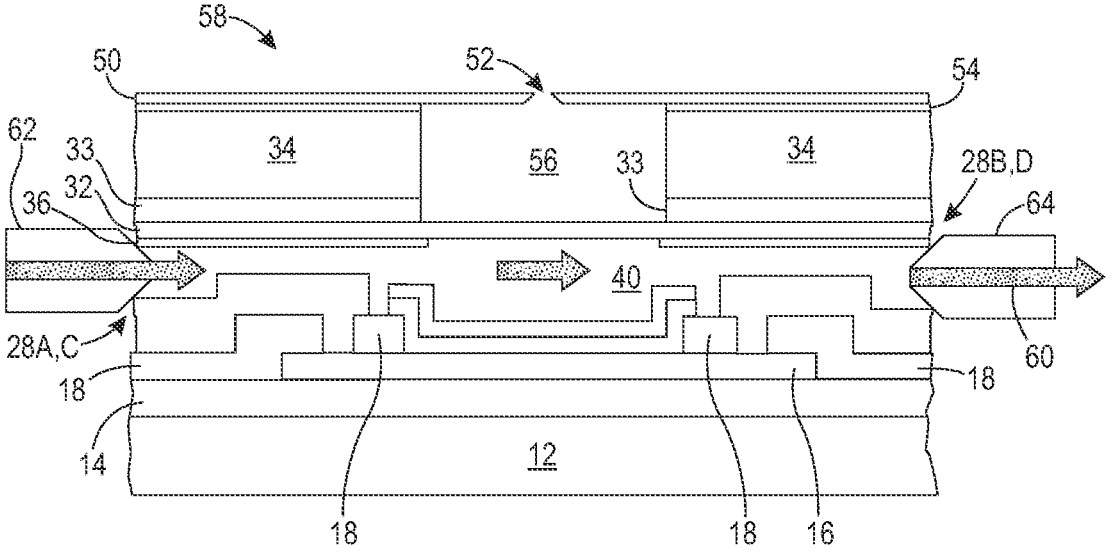

After completing a structure similar to that depicted in FIG. 5, processing may continue to form a completed thermopneumatic actuator TIJ printhead. This may include filling the fluid chamber 40 of each actuator 58 with a working fluid 60 as depicted in FIG. 6, which may be performed, for example, by injecting working fluid 60 into the working fluid chamber 40 under pressure from, for example, a working fluid injection nozzle 62 placed at one or more of the row working fluid inlets 28*a* or column working fluid inlets 28*c* as depicted in FIG. 6. The working fluid 60 may include, for example, ethanol, water, Fluorinert™ FC-72 (i.e., perfluorohexane) available from 3M of St. Paul, Minn., etc. A working fluid vacuum nozzle 64 having a vacuum force placed over one or more of the row working fluid outlets 28*b* or column working fluid outlets 28*d* may assist in flowing the working fluid through the matrix of channels 28, out of the working fluid outlets 28*b*, 28*d*, and containing any excess working fluid 60 after the working fluid chambers 40 are filled. While, FIG. 6 depicts the injection nozzle 62 and the vacuum nozzle 64 contacting a single actuator 58 for simplicity of depiction, it will be understood that a plurality of actuators 58 will be interposed between the injection nozzle and the vacuum nozzle as depicted, for example, in FIG. 2C. Further, while FIGS. 2C and 6 depict individual injection nozzles 62 and vacuum nozzles 64 for each inlet and outlet respectively, a single injection nozzle 66 and vacuum nozzle 68 may service (i.e., supply working fluid to or inject working fluid into) a plurality of inlets and outlets as depicted in FIG. 2D through sealed contact with the exterior of array of actuators 58.

Further, the fluid direction between an injection nozzle 62 and the vacuum nozzle 64 may be reversed during filling of the plurality of working fluid chambers 40, for example to improve the removal of air from the working fluid chambers 40. The working fluid 60 may first injected through the injection nozzles 62 and vacuumed through the vacuum nozzles 64, and then injected through vacuum nozzle 64 and vacuumed through injection nozzle 62. Thus, the nozzles 62, 64 can oscillate between being injection nozzles and vacuum nozzles.

Figure 7:
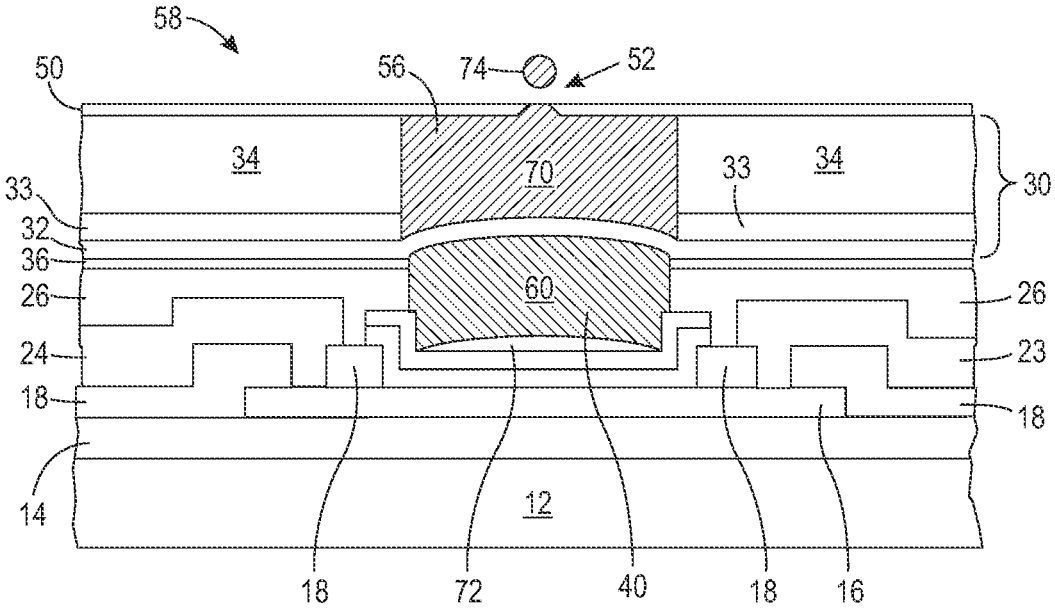

Additionally, the ink chamber 56 may be filled with ink 70 as depicted in FIG. 7 using conventional techniques. The thermo-pneumatic membrane 32 separates the working fluid chamber 40 from the ink chamber 56 across the plurality of individual actuators 58 of the actuator array. Various inks 70, such as aqueous and non-aqueous inks, UV inks, gel inks, conductive inks, and biological fluids may be used in an embodiment of the present teachings.

Figure 8:
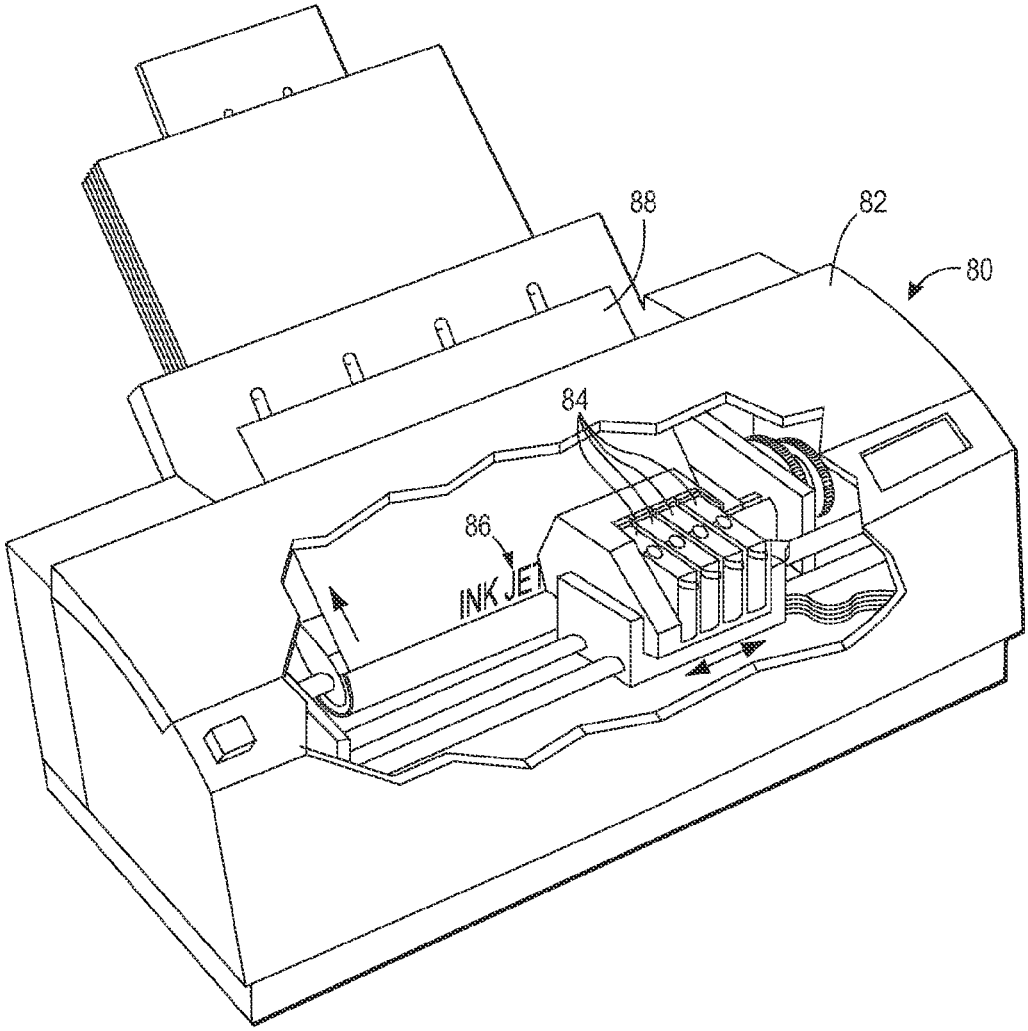
FIG. 8 is a perspective depiction of a printer in accordance with an embodiment of the present teachings.

During use, the resistor 16 may be individually addressed by applying a voltage across the two electrodes 23, 24, which results in heating of the resistor 16. Once the resistor 16 reaches a critical temperature, the working fluid 60 begins to vaporize and forms a bubble 72, which results in a pressure impulse that pressurizes the working fluid chamber 40. The resulting pressure within the working fluid chamber 40 causes the membrane 32 to deflect, thereby decreasing a volume of the ink chamber 56. This volumetric decreases results in ejection of ink 70 from the ejection nozzle 52 as an ink drop 74, which is thereby deposited onto a recording medium 88 (FIG. 8).

The channels 28 in the standoff layer 26 of the array of actuators 58 may be designed with a suitable geometry such that the pressure impulse from the actuation of one or more membranes 32 does not have an excessive pressure effect on adjacent actuators 58 through the channels 28. That is, channels 28 may be designed such that crosstalk during actuation of one actuator results in little or no ejection or leakage of ink through an ejection nozzle of one or more adjacent actuators.

Designing the channel 28 width ($W_1$, $W_2$) and cross-sectional area for a smaller size will decrease crosstalk (i.e., crosstalk is proportional to a cross-sectional area). Inversely, a resistance to the flow of the working fluid 60 through the channel 28 decreases as the width $W_1$, $W_2$ and cross sectional area of the channel 28 increases. That is, a pressure required to inject fluid into the working fluid chambers 40 becomes greater with smaller channel 28 width and cross-sectional area (i.e., injection pressure is inversely proportional to a cross-sectional area). Decreasing flow resistance will increase the fill speed of the working fluid and will decrease the pressure under which the working fluid 60 must be injected into the channels 28 during filling, but may increase crosstalk during ejection of ink. As these two competing factors have opposite influence, an optimization may be performed on any final geometry. For example, a 600 dpi membrane is larger than a 1200 dpi membrane, and influences a larger volume of working fluid. The larger volume of working fluid spread over a greater area increases the tolerance of compliance and allows for some additional latitude in the design of the channels 28.

In an embodiment, the channels 28 within the standoff layer 26 connect the working fluid chambers 40 of a plurality of actuators 58, and may be formed to connect the working fluid chambers 40 of all actuators 58 in the actuator array. During ejection of an ink drop 74 from an ink chamber 56 of an activated actuator 58, working fluid 60 may travel from the working fluid chamber 40 of the activated actuator 58 into a working fluid chamber 58 of an adjacent actuator 58, for example an inactive actuator 58. In an embodiment, for example the embodiment of FIG. 2C, working fluid of an activated actuator 58 may travel into the working fluid chambers 40 of up to four adjacent inactive actuators 58.

In an embodiment, the working fluid inlets 28*a*, 28*c* are in fluid communication with the plurality of channels 28, which are in fluid communication with the plurality of working fluid chambers 40, which are in fluid communication with the working fluid outlets 28*b*, 28*d*. Further, the plurality of wording fluid inlets 28*a*, 28*c* are in fluid communication with the working fluid outlets 28*b*, 28*d* through the plurality of channels 28 and the plurality of working fluid chambers 40. By creating an appropriate channel (flow path) 28 for the working fluid 60 to communicate with, or interconnect, the working fluid chambers 40 below the membrane 32, a working fluid 60 may be introduced into the working fluid chambers 40 of each actuator 58 of the array of actuators after structural fabrication of the device has been completed. Additionally, the working fluid may flow or recirculate during operation of the printhead. Air bubbles within the working fluid 60 have a dampening effect on the amplitude of a pressure pulse during activation of an actuator 58. In an embodiment, the working fluid may be removed or otherwise treated to purge the working fluid of air bubbles that might form during operation of the device after an initial use of the printhead for printing, for example as a maintenance process. This would allow any air bubbles that are introduced into the working fluid or form during device operation due to environmental changes or decomposition of the fluid itself to be removed from the working fluid 60.

FIG. 8 depicts a printer 80 including a printer housing 82 into which at least one printhead 84 including an embodiment of the present teachings has been installed. The housing 82 may encase the printhead 84. During operation, ink 86 is ejected from one or more printheads 84. The printhead 84 is operated in accordance with digital instructions to create a desired image on a print medium 88 such as a paper sheet, plastic, etc. The printhead 84 may move back and forth relative to the print medium 88 in a scanning motion to generate the printed image swath by swath. Alternately, the printhead 84 may be held fixed and the print medium 88 moved relative to it, creating an image as wide as the printhead 84 in a single pass. The printhead 84 can be narrower than, or as wide as, the print medium 88. In another embodiment, the printhead 84 can print to an intermediate surface such as a rotating drum, belt, or drelt (not depicted for simplicity) for subsequent transfer to a print medium.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that other structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

The invention claimed is:

1. A printhead comprising a plurality of thermo-pneumatic (TP) actuators as part of a TP actuator array, wherein the TP actuator array comprises:

a substrate;

a plurality of resistors, wherein each resistor of the plurality of resistors is individually addressable;

a standoff layer formed over the substrate, wherein the standoff layer comprises a plurality of channels therethrough that extend between adjacent TP actuators of the TP actuator array;

a TP actuatable membrane between a working fluid chamber and an ink chamber for each of the plurality of TP actuators, wherein the TP actuatable membrane is attached to the standoff layer;

a support layer attached to the TP actuatable membrane, wherein the TP actuatable membrane is interposed between the support layer and the standoff layer;

a nozzle plate attached to the support layer;

at least one working fluid inlet on an exterior surface of the TP actuator array; and at least one working fluid outlet on the exterior surface of the TP actuator array, wherein the plurality of channels are each in fluid communication with the at least one working fluid inlet and the at least one working fluid outlet.

2. The printhead of claim 1, wherein the working fluid chamber for each of the plurality of TP actuators is in fluid communication with the at least one working fluid inlet and the at least one working fluid outlet through at least one channel of the plurality of channels.

3. The printhead of claim 2, further comprising a working fluid within the working fluid chamber for each of the plurality of TP actuators, wherein the working fluid within each of the working fluid chambers is free to flow into the working fluid chamber of an adjacent actuator during operation of the printhead.

4. The printhead of claim 3, wherein the working fluid chamber of each TP actuator of the TP actuator array includes at least four channels opening thereinto.

5. A printer, comprising:

a printhead comprising a plurality of thermo-pneumatic (TP) actuators as part of a TP actuator array, wherein the TP actuator array comprises:

a substrate;

a plurality of resistors, wherein each resistor of the plurality of resistors is individually addressable;

a standoff layer formed over the substrate, wherein the standoff layer comprises a plurality of channels therethrough that extend between adjacent TP actuators of the TP actuator array;

a TP actuatable membrane between a working fluid chamber and an ink chamber for each of the plurality of TP actuators, wherein the TP actuatable membrane is attached to the standoff layer;

a support layer attached to the TP actuatable membrane, wherein the TP actuatable membrane is interposed between the support layer and the standoff layer;

a nozzle plate attached to the support layer;

at least one working fluid inlet on an exterior surface of the TP actuator array; and at least one working fluid outlet on the exterior surface of the TP actuator array, wherein the plurality of channels are each in fluid communication with the at least one working fluid inlet and the at least one working fluid outlet; and a printer housing that encases the printhead.

6. The printer of claim 5, wherein the working fluid chamber for each of the plurality of TP actuators is in fluid communication with the at least one working fluid inlet and the at least one working fluid outlet through at least one channel of the plurality of channels.

7. The printer of claim 6, wherein the printhead further comprises a working fluid within the working fluid chamber for each of the plurality of TP actuators, wherein the working fluid within each of the working fluid chambers is free to flow into the working fluid chamber of an adjacent actuator during operation of the printhead.

8. The printer of claim 7, wherein the working fluid chamber of each TP actuator of the TP actuator array includes at least four channels opening thereinto.

9. A method for forming a printhead comprising a plurality of thermo-pneumatic (TP) actuators as part of a TP actuator array, wherein the method comprises:

providing a substrate and a plurality of individually addressable resistors;

forming a standoff layer over the substrate;

etching the standoff layer to form a plurality of channels through the standoff layer;

attaching a TP actuatable membrane to the standoff layer to form a plurality of working fluid chambers over the plurality of resistors such that the plurality of channels through the standoff layer open into the plurality of working fluid chambers;

attaching a support layer to the actuatable membrane;

forming at least one working fluid inlet on an exterior surface of the TP actuator array during the etching of the standoff layer;

forming at least one working fluid outlet on the exterior surface of the TP actuator array during the etching of the standoff layer; and injecting a working fluid into the at least one working fluid inlet such that the working fluid flows into the plurality of working fluid chambers, wherein the TP actuatable membrane is interposed between the support layer and the standoff layer.

10. The method of claim 9, further comprising flowing the working fluid through the plurality of working fluid chambers and out of the working fluid outlet.

11. The method of claim 10, further comprising:

placing a vacuum nozzle over the working fluid outlet; and exerting a vacuum force on the working fluid outlet during the injection of working fluid into the working fluid inlet.

* * * * *